US008234117B2

(12) United States Patent
Nakao

(10) Patent No.: US 8,234,117 B2
(45) Date of Patent: Jul. 31, 2012

(54) SPEECH-SYNTHESIS DEVICE HAVING USER DICTIONARY CONTROL

(75) Inventor: Muneki Nakao, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1286 days.

(21) Appl. No.: 11/689,974

(22) Filed: Mar. 22, 2007

(65) Prior Publication Data

US 2007/0233493 A1 Oct. 4, 2007

(30) Foreign Application Priority Data

Mar. 29, 2006 (JP) ..... 2006-091932

(51) Int. Cl.
*G10L 13/00* (2006.01)
*G10L 21/00* (2006.01)

(52) U.S. Cl. ..... 704/258; 704/270

(58) Field of Classification Search ..... 704/258–269, 704/270

See application file for complete search history.

(56) References Cited

U.S. PATENT DOCUMENTS

| | | | | |
|---|---|---|---|---|
| 5,634,084 | A * | 5/1997 | Malsheen et al. | 704/260 |
| 5,651,095 | A * | 7/1997 | Ogden | 704/260 |
| 5,754,686 | A * | 5/1998 | Harada et al. | 382/187 |
| 5,765,179 | A | 6/1998 | Sumita et al. | |
| 5,787,231 | A * | 7/1998 | Johnson et al. | 704/260 |
| 5,850,629 | A * | 12/1998 | Holm et al. | 704/260 |
| 6,016,471 | A * | 1/2000 | Kuhn et al. | 704/266 |
| 6,078,885 | A * | 6/2000 | Beutnagel | 704/258 |
| 6,208,755 | B1 * | 3/2001 | Mori et al. | 382/187 |
| 6,826,530 | B1 | 11/2004 | Kasai et al. | |
| 7,117,159 | B1 * | 10/2006 | Packingham et al. | 704/275 |
| 7,630,898 | B1 * | 12/2009 | Davis et al. | 704/266 |
| 2002/0143828 | A1 * | 10/2002 | Montero et al. | 707/533 |
| 2005/0256716 | A1 * | 11/2005 | Bangalore et al. | 704/260 |
| 2005/0267757 | A1 * | 12/2005 | Iso-Sipila et al. | 704/260 |
| 2006/0074672 | A1 * | 4/2006 | Allefs | 704/258 |
| 2007/0239455 | A1 * | 10/2007 | Groble et al. | 704/260 |

FOREIGN PATENT DOCUMENTS

| | | | |
|---|---|---|---|
| JP | 02-027396 | A | 1/1990 |
| JP | 08-063478 | A | 3/1996 |
| JP | 08-272392 | A | 10/1996 |
| JP | 2000-187495 | A | 7/2000 |
| JP | 2001-034282 | A | 2/2001 |
| JP | 2001-350489 | A | 12/2001 |
| JP | 2004-013850 | A | 1/2004 |
| JP | 2006-098934 | A | 4/2006 |

* cited by examiner

*Primary Examiner* — Jialong He
(74) *Attorney, Agent, or Firm* — Canon USA, Inc., IP Division

(57) ABSTRACT

In a speech-synthesis device, it is possible to determine whether or not a user dictionary that supports processing for reading aloud a specific phrase associated with specific reading should be used. The speech-synthesis device includes a speech-synthesis unit configured to perform read-aloud processing, a user dictionary provided to support processing for reading aloud a specific phrase associated with specific reading, and a control unit that includes a plurality of functions achieved by using information about the read-aloud processing, that determines whether or not the user dictionary should be used according to which of the functions is used so as to perform the read-aloud processing, and that makes the speech-synthesis unit perform the read-aloud processing.

7 Claims, 6 Drawing Sheets

SPEECH-SYNTHESIS DEVICE HAVING USER DICTIONARY CONTROL

BACKGROUND OF THE INVENTION

1. Field of the Invention

The present invention relates to speech-synthesis processing performed in an information-communication device that is connected to a communication line and that is ready for multimedia communications capable of transmitting and/or receiving speech data, video data, an electronic mail, and so forth.

2. Description of the Related Art

In the past, speech-synthesis devices are usually installed in an apparatus and/or a system for public use, such as a vending machine, an automatic-ticket-examination gate, and so forth. Recently, however, the number of devices having a speech-synthesis function increases, and it is not uncommon to install the speech-synthesis function in relatively low-priced consumer products including a telephone, a car-navigation system, and so forth. Subsequently, efforts are being made to increase the user-interface capability of personal devices.

Incidentally, the above-described personal devices have become increasingly multifunctional. For example, some of car-navigation systems have not only a route-guide function, but also an audio function and an internet-browsing function including a network-connection function, which makes the car-navigation systems multifunctional.

Likewise, the telephones or the like have become increasingly multifunctional. Namely, not only the telephone function, but also the network-connection function and/or a scheduler function are installed in the telephones, which make the telephones multifunctional.

Further, a function achieved by using the speech-synthesis technology is mounted in each of the functions mounted in the device such as the telephone, the functions making the telephones multifunctional. The speech-synthesis function provided in the device is used for many purposes.

For example, according to an example relationship between the composite function and the speech-synthesis function of the telephone, an incoming-call-read-aloud function, a phone-directory-read-aloud function, and so forth can be achieved, as the telephone function.

Further, a schedule-notification function can be achieved, as the scheduler function. Further, for the network-connection function, a home-page-read-aloud function, a mail-read-aloud function, and so forth are provided, as the speech-synthesis function.

Hereinafter, known technologies will be discussed. First, a method of estimating information about the field of document data stored in a document database, and switching between recognition dictionaries used during character-recognition processing according to the estimated field information is known. The above-described method is disclosed in Japanese Patent Laid-Open No. 8-63478, for example. According to the above-described method, the contents of a document to be read aloud may be necessarily examined in advance.

Further, a known system configured to switch between speaker-by-speaker-word dictionaries on the basis of input speaker information when details on text data to be read aloud are analyzed, so as to perform the speech-synthesis processing, is disclosed in Japanese Patent Laid-Open No. 2000-187495, for example.

Further, there has been proposed a method of switching between dictionaries for each of tasks of a specific function of a device, where the specific function is a game program, and reading aloud a phrase of which information is stored in the game program in advance, so as to perform the speech-synthesis processing. The above-described method is disclosed in Japanese Patent Laid-Open No. 2001-34282, for example.

The speech-synthesis function of a known device often includes a user-dictionary function. In the case where a language using readings in kana, such as Japanese, is used, the reading of the word "三部"becomes "mitsube", when the word refers to a personal name. However, when the word "三部"does not refer to the personal name, the reading of the word "三部"becomes "sanbu (three copies)".

When the speech-synthesis function is provided, as the telephone function, it is preferable that the device reads aloud a message, as "You have a phone call from Mr. Mitsube", upon receiving an incoming-phone call, and reads aloud a message, as "I am going to dial Mr. Mitsube", when a user dials to Mr. Mitsube.

When the word "三部"is registered with a user dictionary of the speech-synthesis function so that the word is read, as "mitsube", the word "三部"is appropriately read aloud when the speech-synthesis function is used, as the telephone function. However, when the device has a home-page-read-aloud function operating in synchronization with the speech-synthesis function and when a home-page shows the sentence "You need three copies of the book", for example, the device reads aloud the sentence, as "You need mitsube of the book", which makes it difficult for the device to inform the user of the contents of the home page correctly.

In the case where a language using no readings in kana, such as English, is used, the reading of the word "Elizabeth" often becomes "Beth" and/or "Liz" denoting the nickname of a person named as Elizabeth, when the word "Elizabeth" refers to a personal name. However, when the word "Elizabeth" is used, as the name of a place, a park, or a building, the reading of the word "Elizabeth" is not changed into that of the nickname.

As in the above-described example, when the word "Elizabeth" is registered with the user dictionary so that the word is read, as "Liz", and when the telephone function is used, the device reads aloud a message, as "You have a phone call from Liz", upon receiving an incoming call. However, when a home page shows the phrase "the city of Elizabeth", as a place name, the device reads aloud the phrase, as "the city of Liz", which makes it difficult for the device to inform the user of the contents of the home page correctly.

The above-described example shows the case where a single device includes at least two functions. One of the functions is achieved by abbreviating and/or reducing the pronunciation and/or word of a predetermined phrase so that the user of the device can easily understand the meaning of the phrase. However, according to the other function, the abbreviation and/or reduction of the pronunciation and/or word of the predetermined phrase does not make the phrase understandable for the user.

According to another example, one of the meanings of an English abbreviation "THX" is the name of a theater system used for a movie theater. In that case, the word "THX" is pronounced, as three letters "T", "H", and "X" of the alphabet.

On the other hand, an enterprise named as "The Houston Exploration" is referred to as the abbreviation "THX" in the stock market or the like. However, the name of the enterprise is pronounced, as "The Houston Exploration" in news reports or the like.

However, the word "THX" used in an ordinary letter and/or mail is an abbreviation of the word "Thanks", where the abbreviation is used, so as to reduce the trouble to write the word "thanks". In that case, the word "THX" is pronounced, as "Thanks".

Thus, since the word "THX" has three meanings and three readings, the word "THX" can be used in three different ways according to the situation where the word "THX" is used. The above-described example shows the case where a predetermined single word has a plurality of readings and meanings. If the word "THX" is uniformly read aloud according to the definition thereof registered with the user dictionary irrespective of the current situation and/or the currently used function, the meaning and/or reading of the word "THX" becomes significantly different from what it should be.

Thus, the pronunciation and/or reading of a single written word often changes according to the situation where the word is used all across the world. The above-described trouble will be specifically described, as below.

That is to say, it is difficult to read aloud data correctly by using a device including a composite function. Particularly, it is difficult to read aloud data correctly by using a device including a function of reading data obtained through network browsing without storing data on a phrase to be read aloud in the device, a function of inputting data on phrases that fall within an object range which is so large that it is difficult to store the phrase data in the device in advance, as phone-directory data, through the user, and reading aloud the phrase data, and so forth. Here, the latter function corresponds to the phone-directory function, for example.

Thus, with regard to the reading of a phrase, in a device having a plurality of different functions including a function of reading phrases to be read aloud, where the phrases fall within a large object range, a function of reading aloud private information, a function of reading aloud general information including no private information, the contents of a user dictionary shared in the device uniformly affect the above-described functions. Therefore, an error may occur in each of the functions, depending on which of the phrases registered with the user dictionary is read aloud.

SUMMARY OF THE INVENTION

The present invention provides a speech-synthesis device that can perceive whether or not a user dictionary provided in a speech-synthesis function should be used even though a specific phrase associated with specific reading is registered with the user dictionary and that can read aloud data appropriately for each of functions installed in the speech-synthesis device.

According to an aspect of the present invention, a speech-synthesis device is provided which includes a speech-synthesis unit configured to perform read-aloud processing; a user dictionary provided so as to support read aloud processing of a specific phrase associated with a specific reading; and a control unit that includes a plurality of functions achieved by using information about the read-aloud processing. The control unit determines whether or not the user dictionary should be used according to which of the functions is used, so as to perform the read-aloud processing, and that controls the speech-synthesis unit to perform the read-aloud processing.

According to another aspect of the present invention, a method is provided for controlling a speech-synthesis device using a user dictionary provided so as to support read aloud processing of a specific phrase associated with a specific reading. The control method includes synthesizing speech so as to be able to perform read-aloud processing; determining whether or not the user dictionary should be used according to which of a plurality of functions achieved by using information about the read-aloud processing is used; and performing control so as to perform the read-aloud processing.

And, according to yet another aspect of the present invention, a computer readable medium is provided containing computer-executable instructions for controlling a speech-synthesis device configured to synthesize speech by using a user dictionary provided so as to support read aloud processing of a specific phrase associated with specific reading. Here, the computer readable medium includes computer-executable instructions for synthesizing speech so as to perform read-aloud processing; computer-executable instructions for determining whether or not the user dictionary should be used according to which of a plurality of functions achieved by using information about the read-aloud processing is used; and computer-executable instructions for performing control so as to perform the read-aloud processing.

Further features and aspects of the present invention will become apparent from the following description of exemplary embodiments with reference to the attached drawings.

DESCRIPTION OF THE EMBODIMENTS

Embodiments of the present invention will be described with reference to the attached drawings.

First Exemplary Embodiment

Figure 1:
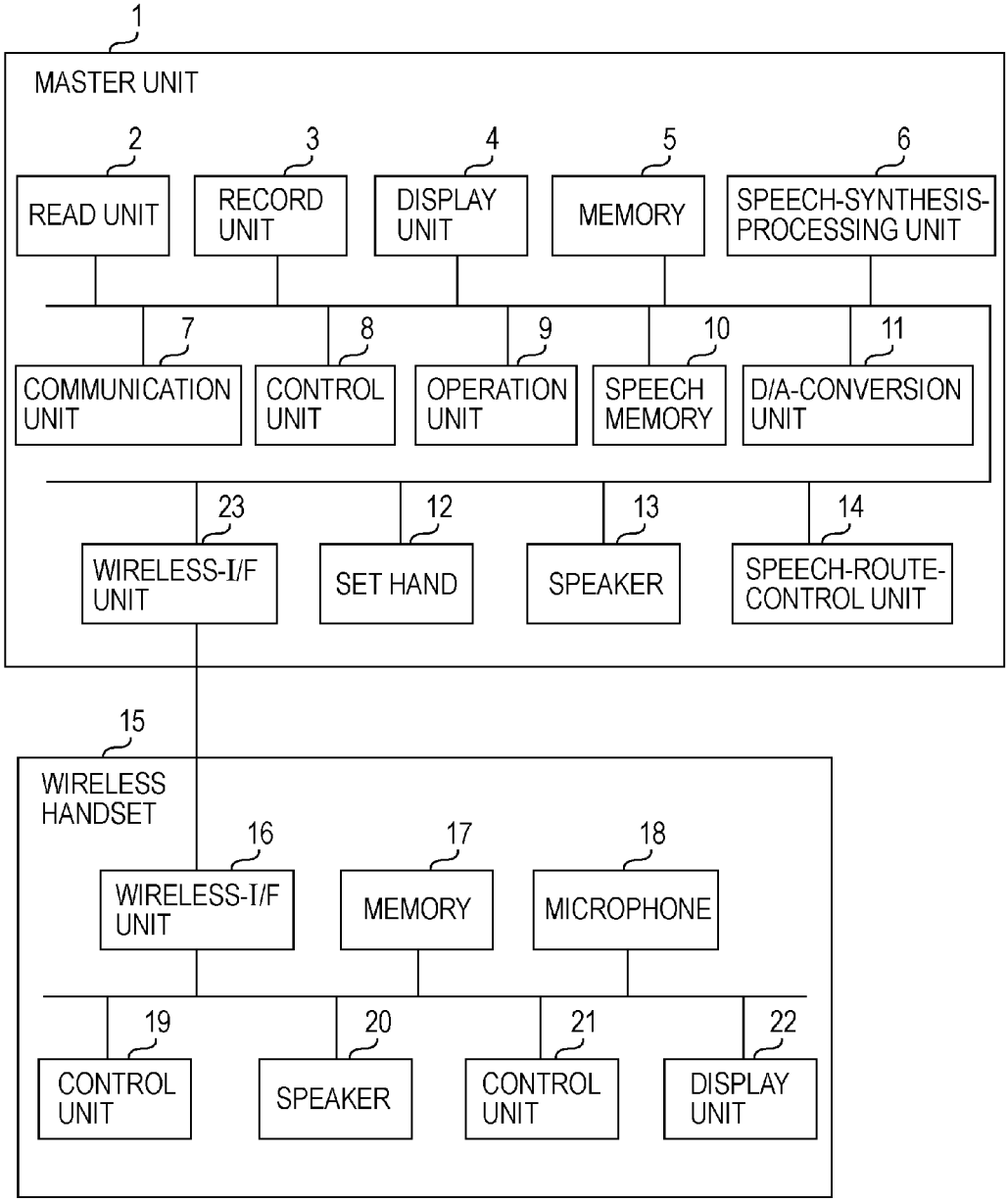
FIG. 1 is a block diagram illustrating a facsimile device with a cordless telephone according to an exemplary embodiment of the present invention.

FIG. 1 is a block diagram illustrating a facsimile-device-with-cordless-telephone FS1 according to an embodiment of the present invention. The facsimile-device-with-cordless-telephone FS1 includes a master unit 1 of the facsimile device and a wireless handset 15.

The master unit 1 includes a read unit 2, a record unit 3, a display unit 4, a memory 5, a speech-synthesis-processing unit 6, a communication unit 7, a control unit 8, an operation unit 9, a speech memory 10, a digital-to-analog (D/A) conversion unit 11, a handset 12, a wireless interface (I/F) unit 23, a speaker 13, and a speech-route-control unit 14.

The read unit 2 is configured to read document data and includes a removable scanner or the like capable of scanning data in lines. The record unit 3 is configured to print and/or output data on various reports including video signals, an apparatus constant, and so forth.

The display unit 4 shows guidance on operations such as registration operations, various alarms, time information, the apparatus state, and so forth. The display unit 4 further shows the phone number and/or name of a person on the other end of the phone on the basis of sender information transmitted through the line at the reception time.

The memory 5 is an area provided, so as to store various data, and stores information about a phone directory and/or various device settings registered by a user, FAX-reception data, speech data on an automatic-answering message and/or a recorded message, and so forth. The phone directory includes items of data on the "name" (free input), "readings in kana (Japanese syllabaries)", "phone number", "mail address", and "uniform resource locator (URL)" of the person on the other end of the line in association with one another.

The speech-synthesis-processing unit 6 performs language analysis of data on input text, converts the text data into acoustic information, converts the acoustic information into a digital signal, and outputs the digital signal. The communication unit 7 includes a modem, a network control unit (NCU), and so forth. The communication unit 7 is connected to a communication network and transmits and/or receives communication data.

The control unit 8 includes a microprocessor element or the like and controls the entire facsimile device FS1 according to a program stored in a read-only memory (ROM) that is not shown. An operator registers data on the phone directory and/or makes the device settings via the operation unit 9. Information about details on the registered data and/or the device settings is stored in the memory 5.

The D/A-conversion unit 11 converts the digital signal transmitted from the speech-synthesis-processing unit 6 into an analogy signal at predetermined intervals and outputs the analog signal, as speech data. The handset 12 is used, so as to make a phone call. The wireless-I/F unit 23 is an interface unit used when wireless communications are performed between the master unit 1 and the wireless handset 15. The wireless-I/F unit 23 transmits and/or receives the speech data, data on a command, and data between the master unit 1 and the wireless handset 15.

The speaker 13 outputs monitor sound of an outside call and/or an inside call, a ringtone, read-aloud speech achieved through speech-synthesis processing, and so forth. The speech-route-control unit 14 connects a speech-input-and-output terminal extending from the handset 12 of the master unit 1 to a line-input-and-output terminal. Likewise, the speech-route-control unit 14 connects the speech-input-and-output terminal extending from the handset 12 of the master unit 1 to a speech-input-and-output terminal of the wireless handset 15. The speech-route-control unit 14 further connects an output terminal of a ringtone synthesizer of the master unit 1, though not shown, to the speaker 13, the D/A-conversion unit 11 to the speaker 13, the D/A-conversion unit 11 to the line, and so forth. Thus, the speech-route-control unit 14 connects various speech devices to one another.

The wireless handset 15 includes a wireless-I/F unit 16, a memory 17, a microphone 18, a control unit 19, a speaker 20, an operation unit 21, and a display unit 22. The wireless-I/F unit 16 functions, as an interface unit used when wireless communications are performed between the wireless handset 15 and the master unit 1. The wireless-I/F unit 16 transmits and/or receives speech data, data on a command, and various data between the master unit 1 and the wireless handset 15.

The memory 17 stores data transmitted from the master unit 1 via the wireless-I/F unit 16 and various setting values or the like provided so that the user can select a desired ringtone of the wireless handset 15.

The microphone 18 is used when the phone call is made. The microphone 18 is also used during speech-data input and speech-data recognition.

The control unit 19 includes another microprocessor element or the like and controls the entire wireless handset 15 according to a program stored in a ROM that is not shown. The speaker 20 is used when the phone call is made.

The operation unit 21 is used by the operator, so as to make detailed settings on the reception-sound volume, the ringtone, and so forth, or register data on a phone directory designed specifically for the wireless handset 15. The display unit 22 performs dial display or shows the phone number of the person on the other end of the phone by using a number-display function through the wireless handset 15. Further, the display unit 22 shows information about a result of the speech recognition to the operator, the speech-identification-result information being transmitted from the master unit 1.

Figure 2:
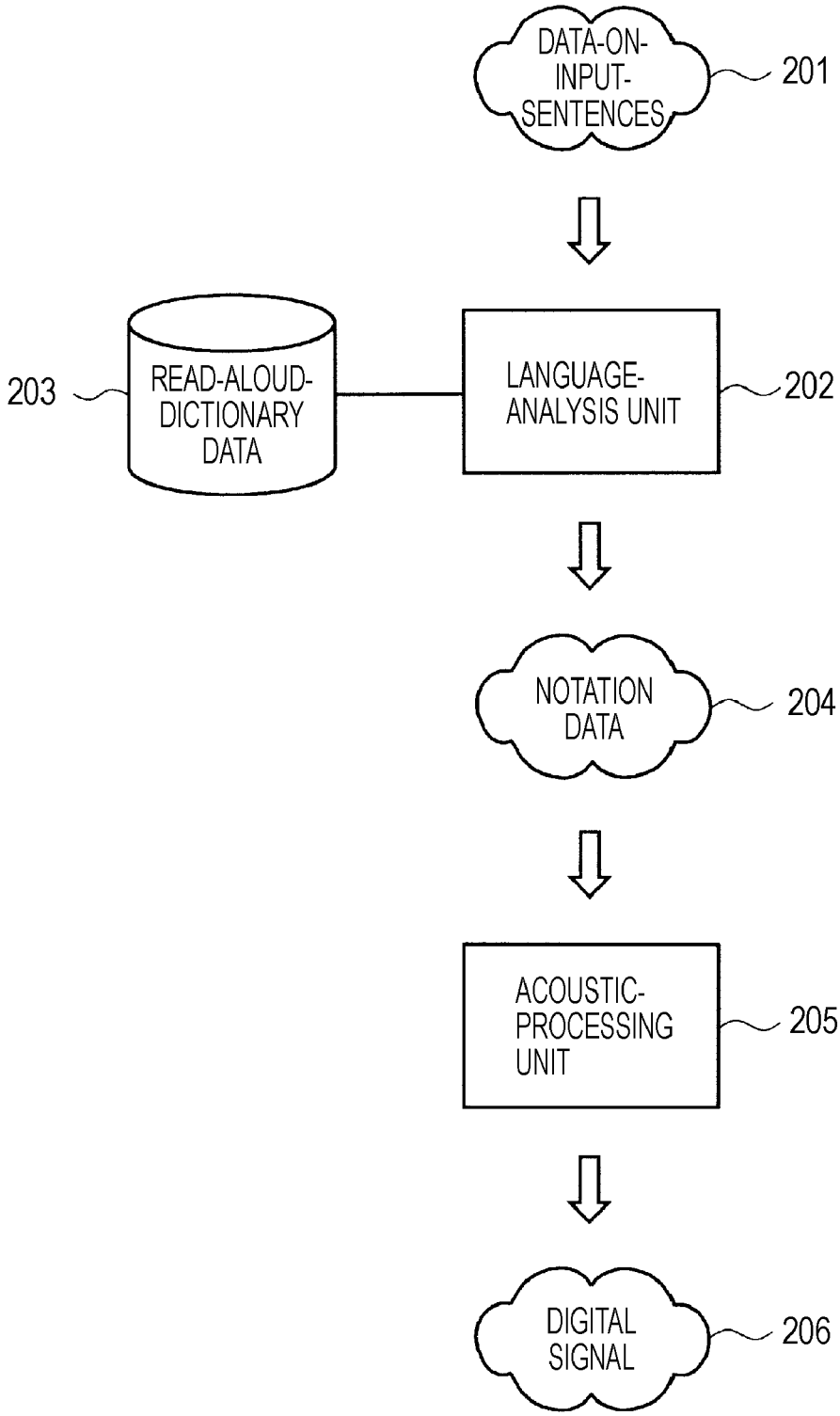
FIG. 2 is a flowchart showing exemplary processing performed when data on sentences is input during speech-synthesis processing.

FIG. 2 is a flowchart showing exemplary processing performed when text data is input during the speech-synthesis processing. In particular, FIG. 2 shows the flow of processing procedures that can be performed by using a language-analysis unit 202, read-aloud-dictionary data (dictionary data to be read aloud) 203, and an acoustic-processing unit 205 that are included in the functions of the speech-synthesis-processing unit 6.

When data-on-input-sentences 201 to be read aloud is transmitted to the speech-synthesis-processing unit 6, the language-analysis unit 202 refers to the read-aloud-dictionary data 203, and divides the data-on-input-sentences 201 into accent phrases, where information about accents, pauses, and so forth is added to the divided accent phrases so that acoustic information is generated. The language-analysis unit 202 converts the acoustic information into notation data 204 expressed by text data and/or a frame.

Upon receiving the notation data 204, the acoustic-processing unit 205 converts the notation data 204 into phonemic-element data expressed in 8-bit resolution so that a digital signal 206 can be obtained.

And further, if the notation data 204 can be prepared in advance, the language-analysis unit 202 may not perform the above-described processing.

Figure 3:
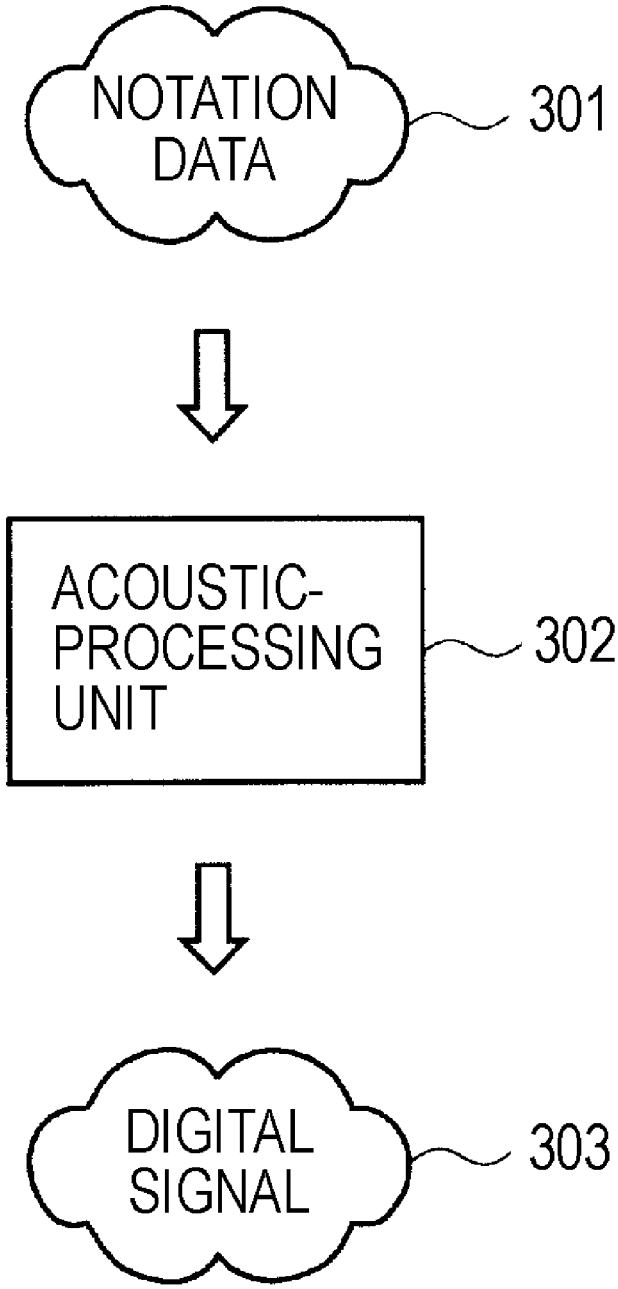
FIG. 3 is a flowchart showing exemplary operations performed, so as to achieve the processing shown in FIG. 2, except processing performed by a language-analysis unit.

FIG. 3 is a flowchart showing exemplary operations performed, so as to achieve the processing shown in FIG. 2, except the processing performed by the language-analysis unit 202.

For example, when the facsimile device FS1 gives guidance which says "I'm going to start data transmission" to the user who is going to transmit data through the facsimile device FS1, data on a sentence including kanji characters and kana characters, such as "I'm going to start data transmission" is not necessarily transmitted to the speech-synthesis-processing unit 6. Namely, data on a sentence {Data transmission/is/started} is transmitted to the acoustic-processing unit 302, as notation data 301 to which information about accents, pauses, and so forth is added, so that a desired digital signal 303 can be obtained. Here, the acoustic-processing unit 302 has the same configuration as that of the acoustic-processing unit 205.

According to the first embodiment, the text inside the parentheses { } denotes the details on a sentence to be read aloud. Namely, when data on predetermined sentences such as a guidance message to be read aloud is subjected to the speech-synthesis processing, a plurality of types of notation data may be stored in a ROM provided in the facsimile device FS1 so that the language-analysis processing can be omitted and the data on the predetermined sentences can be read aloud correctly without any errors.

Figure 4:
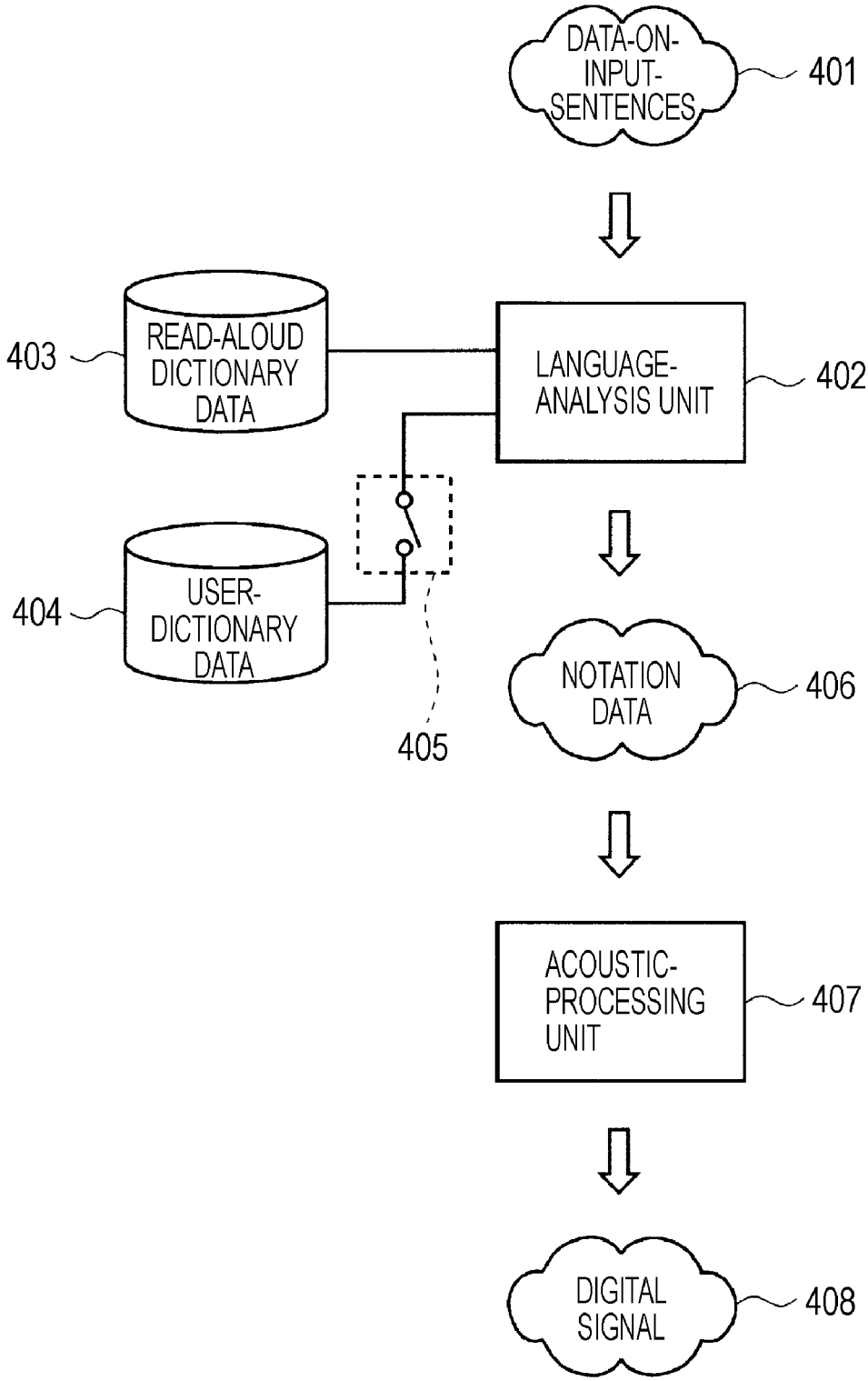
FIG. 4 is a flowchart showing exemplary processing performed according to contents of a user dictionary when the data on sentences is input during the speech-synthesis processing.

FIG. 4 is a flowchart showing exemplary processing performed according to details on a user dictionary when data on sentences is input during the speech-synthesis processing. First, the speech-synthesis-processing unit 6 includes a language-analysis unit 402, read-aloud-dictionary data 403, user-dictionary data 404, a soft switch 405, and an acoustic-processing unit 407. FIG. 4 briefly shows a configuration of the speech-synthesis-processing unit 6, the configuration being provided, so as to perform processing according to details on the user dictionary.

When data-on-input-sentences 401 to be read aloud is transmitted to the speech-synthesis-processing unit 6, the language-analysis unit 402 refers to the read-aloud-dictionary data 403, and divides the data-on-input-sentences 401 into accent phrases. When the soft switch 405 provided, so as to determine whether or not the user-dictionary data 404 should be used, is turned on, the data-on-input-sentences 401 is analyzed according to the user-dictionary data 404 rather than the read-aloud-dictionary data 403. That is to say, a higher priority is given to the user-dictionary data 404 than to the read-aloud-dictionary data 403.

On the contrary, when the soft switch 405 is turned off, the data-on-input-sentences 401 is analyzed without being affected by the details on the user-dictionary data 404 and notation data is generated. Then, acoustic information to which information about accents, pauses, and so forth is added is converted into notation data 406 expressed by text data and/or a frame. Upon receiving the notation data 406, the acoustic-processing unit 407 converts the notation data 406 into phonemic-element data expressed in 8-bit resolution so that a digital signal 408 is obtained.

The soft switch 405 is switched between the off state and the on state by a higher-order function (the Web and/or a mail application shown in FIG. 5, for example) achieved by using speech synthesis before performing the speech-synthesis processing.

Figure 5:
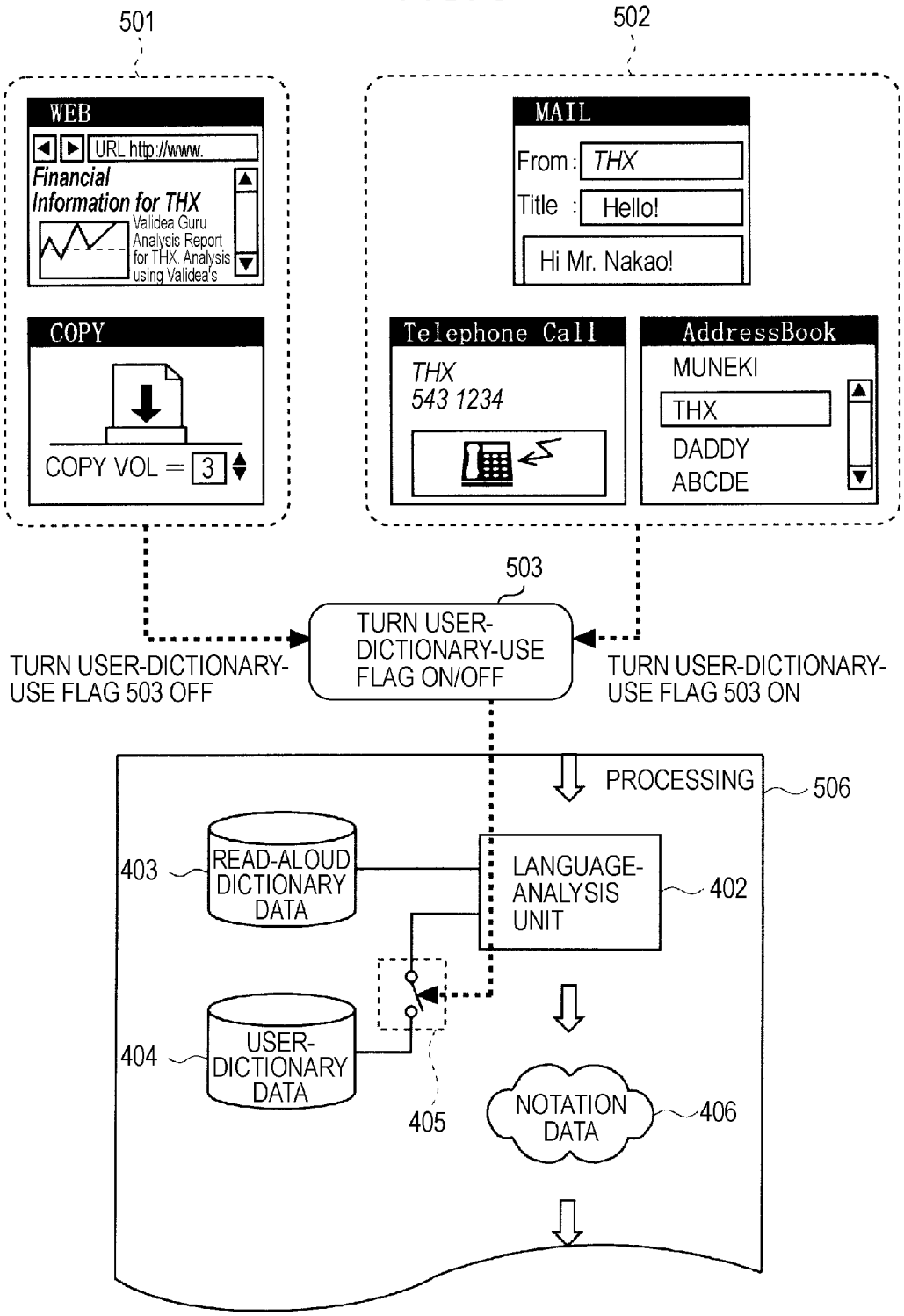
FIG. 5 is a flowchart briefly showing operations performed, so as to determine whether or not the speech-synthesis processing shown in FIG. 4 is performed according to the details on user-dictionary data for each of operations performed in the facsimile device.

FIG. 5 is a flowchart showing exemplary operations performed, so as to determine whether or not the speech-synthesis processing shown in FIG. 4 is performed according to the details on user-dictionary data 404 for each of operations performed in the facsimile device FS1.

First, in the following description, an operation group 501 achieved by without using the user-dictionary data 404 uses a speech-synthesis function. Usually, the operation group 501 including a Web-application program or the like achieved without using the user-dictionary data 404, is provided, mainly for reading public information including newspaper information, shopping information, and information about a weather report, a city hall, and so forth, and/or contents including mass-media information rather than reading private information about the user of the facsimile device FS1.

Subsequently, when the user-dictionary data 404 is set to the facsimile device FS1 so that a predetermined personal name or the like is read aloud in a special way, and the above-described information is read aloud according to the user-dictionary data 404, an error occurs.

The above-described error is described below. For example, when the user adds data to the user-dictionary data 404 of the speech-synthesis function so that the word "THX" is read aloud, as "THE HOUSTON EXPLORATION", the word "THX" is appropriately read aloud for the telephone function, as information about a destination and/or the name of an incoming-call receiver. On the other hand, however, when the user browses a movie site by using the WEB function of the facsimile device 1, a sentence which reads "The THX system is not a recording technology" shown on the movie site is read aloud, as "The THE HOUSTON EXPLORATION system is not a recording technology". Thus, it is difficult to notify the user of details on the sentence by speech data achieved by the speech-synthesis function.

Therefore, when making the WEB-application program operate, the soft switch 405 provided, so as to determine whether or not the user-dictionary data 404 should be used, is turned off, and a user-dictionary-use flag (a flag showing that the user dictionary is used) 503 is turned off. Next, the user-dictionary-use flag 503 is referred to and processed during the speech-synthesis processing.

In FIG. 5, during processing 506 performed by the language-analysis unit 402 shown in FIG. 4, the on state and/or the off state of the user-dictionary-use flag 503 is referred to. When the user-dictionary-use flag 503 is turned on, the read-aloud-dictionary data 403 and the user-dictionary data 404 are referred to during the processing performed by the language-analysis unit 402. At that time, a higher priority is given to the contents of the user-dictionary data 404 so that speech data generated according to contents of data registered by the user can be output.

Further, when the user-dictionary-use flag 503 is turned off, the read-aloud-dictionary data 403 alone is referred to during the processing performed by the language-analysis unit 402, and the speech-synthesis processing is performed.

Namely, if the user adds data denoting "THX"="THE HOUSTON EXPLORATION" to the user-dictionary data 404, for example, the speech-synthesis processing is performed so that the word "THX" is read aloud, as "T", "H", and "X".

Further, as is the case with the operations of the WEB-application program, a copy-application program and/or a mail-application program is provided, as an operation group achieved without using the user-dictionary data 404. Processing procedures performed according to the copy-application program and/or the mail-application program are the same as the above-described processing procedures. Namely, when operations of each of the copy-application program and the mail-application program are performed, the soft switch 405 provided, so as to determine whether or not the user-dictionary data 404 should be used, is turned off, and speech-synthesis processing is performed in conjunction with the operations of each of the above-described application programs without using the user-dictionary data 404.

A phone-directory-application program can be provided, for example, as an operation group 502 achieved by using the user-dictionary data 404.

In that case, if the user adds the data denoting "THX"="THE HOUSTON EXPLORATION" to the user-dictionary data 404, the word "THX" is read aloud, as "THE HOUSTON EXPLORATION". Therefore, if the speech-synthesis processing is performed, so as to generate the speech data "I am going to dial THX", processing is performed, so as to read aloud the speech data "I am going to dial THE HOUSTON EXPLORATION".

Usually, in the operation group 502 achieved by using the user-dictionary data 404, private data on the user of the facsimile device FS1 is added to the user-dictionary data 404. A function relating to a telephone, a phone directory, an incoming call, and so forth, and/or a function relating to an electronic mail corresponds to the operation group 502.

When making the above-described functions operate, the soft switch 405 provided, so as to determine whether or not the user-dictionary data 404 should be used, is turned on, and the user-dictionary-use flag 503 is turned on. Next, during the speech-synthesis processing, the user-dictionary-use flag 503 is referred to, the language-analysis unit 402 refers to the user-dictionary data 404, reads aloud contents of the user-dictionary data 404, gives a higher priority to the contents of the user-dictionary data 404 than to the contents of the read-aloud-dictionary data 403, and performs its processing.

According to the first embodiment, the user-dictionary-use flag 503 is used, so as to switch between the case where the speech-synthesis processing is performed by referring to the user-dictionary data 404 and the case where the speech-synthesis processing is performed without referring to the user-dictionary data 404. However, another method and/or system can be used, so as to switch between the above-described cases.

For example, the entire speech-synthesis module may be divided into two modules including a module configured to refer to the user-dictionary data 404 and a module that does not refer to the user-dictionary data 404, and it may be determined which of the two modules should be called up in place of setting the flag through the application program.

Here, according to the mail-application program, an electronic mail distributed from a destination of which address data is not included in mail-address information registered with a device (not shown) is assigned, as an operation group achieved without using the user-dictionary data 404, and an electronic mail distributed from a destination of which address data is included in the mail-address information registered with the device is assigned, as an operation group achieved by using the user-dictionary data 404 (the operation group 502 achieved by using the user-dictionary data 404 is executed).

Here, according to an application program other than the mail-application program, such as an application program provided, so as to deal with an incoming phone call, the incoming phone call made by a first person may be assigned, as an operation group achieved without using the user-dictionary data 404, where data on the first person is not registered with the device in advance, and an incoming-phone call made by a second person may be assigned, as an operation group achieved by using the user-dictionary data 404, where data on the second person is registered with the device in advance. Further, when the phone-directory function is called up and when the above-described first person is selected, an incoming phone call made by the first person may be assigned, as the operation group achieved without using the user-dictionary data 404, and when the above-described second person is selected, an incoming phone call made by the second person may be assigned, as the operation group achieved by using the user-dictionary data 404, as in the above-described embodiment.

Second Exemplary Embodiment

Figure 6:
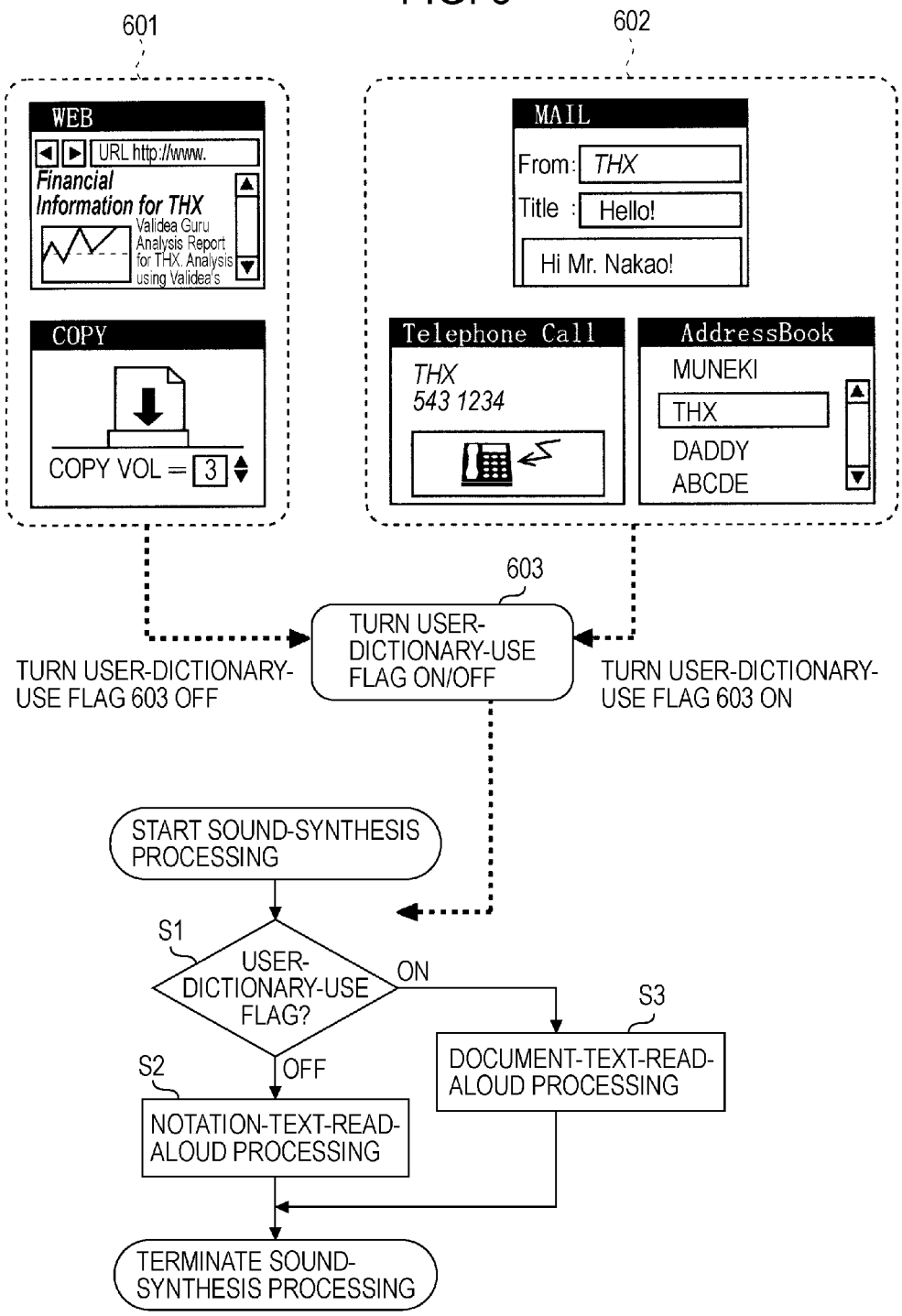
FIG. 6 illustrates exemplary processing procedures performed according to another exemplary embodiment of the present invention.

FIG. 6 illustrates a second embodiment of the present invention. In the second embodiment, the speech-synthesis processing is performed according to a method different from that used in the case illustrated in FIG. 5. Namely, when the user-dictionary data 404 is used, the speech-synthesis processing is performed according to the method shown in FIG. 2, and when the user-dictionary data 404 is not used, the speech-synthesis processing is performed according to the method shown in FIG. 3.

Namely, as for a function that does not use the user-dictionary data 404, the notation data 406 is input in place of document data, as an object of the speech synthesis. Accordingly, it becomes possible to perform read-aloud processing without being affected by the contents of the user-dictionary data 404.

First, in an operation group 601 achieved without using the user-dictionary data 404, the soft switch 405 provided, so as to determine whether or not the user-dictionary data 404 should be used, is turned off and a user-dictionary-use flag 603 is turned off. In an operation group 602 achieved by using the user-dictionary data 404, the soft switch 405 is turned on and the user-dictionary-use flag 603 is turned on.

Next, the speech-synthesis processing is started, and the state of the user-dictionary-use flag 603 is determined. If the user-dictionary-use flag 603 is turned off (S1), the processing advances to notation-text-read-aloud processing (S2). If the user-dictionary-use flag 603 is turned on (S1), the processing advances to document-text-read-aloud processing (S3).

If the notation-text-read-aloud processing (S2) is executed, the processing shown in FIG. 3 is executed. Here, a function subjected to the notation-text-read-aloud processing (S2) is a copy function and/or facsimile (FAX)-transmission function, for example, and first speech guidance provided, so as to instruct the user to set a subject copy and/or perform error cancellation, and second speech guidance provided, so as to instruct the user to perform dial input and/or select a subject-copy-transmission mode, are issued through a speech-synthesis function.

If the above-described first speech guidance and second speech guidance are generated according to the contents of the user-dictionary data 404, each of the above-described first speech guidance and second speech guidance changes its meaning. Therefore, the read-aloud processing for the notation text that had been prepared in the device (S2) is performed.

Further, when the document-text-read-aloud processing (S3) is executed, the processing shown in FIG. 4 is performed. Namely, the soft switch 405 is turned on, so as to use the contents of the user-dictionary data 404, and the read-aloud processing is performed.

Here, a function subjected to the document-text-read-aloud processing (S3) is a function of reading a character string that includes an unrestricted phrase and that is not included in the device in advance. The above-described function includes a WEB-application program, a mail function, a telephone function, and so forth.

Namely, the above-described embodiment introduces an example speech-synthesis device including a user dictionary provided, so as to read aloud a specific phrase associated with specific reading, and a control unit including a plurality of speech-synthesis functions provided, so as to read aloud data by performing speech-synthesis processing, determining whether or not the user dictionary should be used when one of the speech-synthesis functions is called up, and read data aloud.

Further, the above-described embodiment introduces an example method of controlling the speech-synthesis device using the user dictionary provided, so as to read aloud the specific phrase associated with the specific reading. The control method includes a step of having a plurality of speech-synthesis functions provided, so as to read aloud data, and a control step of determining whether or not the user dictionary should be used when one of the speech-synthesis functions is called up, and reading data aloud.

Further, the above-described embodiment can be understood, as a program. Namely, the above-described embodiment introduces an example program provided, so as to synthesize speech by using a user dictionary provided, so as to read aloud a specific phrase associated with specific reading. The program makes a computer execute a step of having a plurality of speech-synthesis functions provided, so as to read aloud data, and a control step of determining whether or not the user dictionary should be used when one of the speech-synthesis functions is called up, and reading data aloud.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-091932 filed on Mar. 29, 2006, which is hereby incorporated by reference herein in its entirety.

What is claimed is:

1. A speech-synthesis device, comprising:

a speech-synthesis unit configured to perform read-aloud processing;

a user dictionary provided to register read-aloud information corresponding to a specific phrase for the speech-synthesis unit according to a user instruction, wherein the user dictionary is configured to be used commonly by a plurality of communication partner selection functions that can register name information corresponding to a name of a communication partner; and a determination unit configured to determine whether the user dictionary is to be used in a case where any one of a plurality of functions using the read-aloud processing by the speech-synthesis unit is selected, wherein the determination unit determines that the user dictionary is to be used in a case where a communication partner selection function is selected and determines that the user dictionary is not to be used in a case where a predetermined function other than the communication partner selection function is selected, and wherein, in a case where any one of the plurality of communication partner selection functions is executed and the read-aloud processing corresponding to the name information is performed by the speech-synthesis unit, whatever communication partner selection function is executed from among the plurality of communication partner selection functions, the speech-synthesis unit performs the read-aloud processing corresponding to the name information by using the user dictionary when the name of the communication partner is read-aloud.

2. The speech-synthesis device according to claim 1, wherein the speech-synthesis unit has a mode of operating by using a combination of at least two dictionaries, and wherein the mode can be selected from at least one speech-synthesis function of calling up speech-synthesis processing.

3. The speech-synthesis device according to claim 1, wherein the speech-synthesis unit has two modes including a mode of performing the read-aloud processing by using the user dictionary and a mode of performing the read-aloud processing without using the user dictionary, and wherein each of the two modes can be selected from the plurality of functions.

4. The speech-synthesis device according to claim 1, wherein when a mail function is selected as the communication partner selection function, the speech-synthesis unit performs the read-aloud processing so that mail distributed from a mail address registered with the speech-synthesis device in advance is read aloud by using the user dictionary and mail distributed from a mail address that is not registered with the speech-synthesis device is read aloud without using the user dictionary.

5. The speech-synthesis device according to claim 1, wherein when at least one of a phone-call-reception function and a phone-directory function is selected as the communication partner selection function, the speech-synthesis unit performs the read-aloud processing for a phone call by using the user dictionary when a phone number of the phone call is registered with the speech-synthesis device in advance, and performs the read-aloud processing for the phone call without using the user dictionary when the phone number of the phone call is not registered with the speech-synthesis device in advance.

6. A method of controlling a speech-synthesis device using a user dictionary provided to register read-aloud information corresponding to a specific phrase for read-aloud processing according to a user instruction, the method comprising:

determining whether the user dictionary is to be used in a case where any one of a plurality of functions using the read-aloud processing is selected; and performing the read-aloud processing, in a case where a communication partner selection function, that can register name information corresponding to a name of a communication partner, is selected, by using the user dictionary according to a determining result and performing the read-aloud processing, in a case where a predetermined function other than the communication partner selection function is selected, without using the user dictionary according to the determining result wherein, the user dictionary is able to be used commonly by a plurality of the communication partner selection functions, and wherein, in a case where any one of the plurality of communication partner selection functions is executed and the read-aloud processing corresponding to the name information is performed, whatever communication partner selection function is executed from among the plurality of communication partner selection functions, the read-aloud processing corresponding to the name information is performed by using the user dictionary when the name of the communication partner is read-aloud.

7. A non-transitory computer readable medium containing computer-executable instructions for controlling a speech-synthesis device using a user dictionary provided to register read-aloud information corresponding to a specific phrase for speech-synthesis processing according to a user instruction, the non-transitory computer readable medium comprising:

computer-executable instructions for determining whether the user dictionary is to be used in a case where any one of a plurality of functions using the read-aloud processing is selected; and computer-executable instructions for performing the read-aloud processing, in a case where a communication partner selection function, that can register name information corresponding to a name of a communication information partner, is selected, by using the user dictionary according to a determining result and performing the read-aloud processing, in a case where a predetermined function other than the communication partner selection function is selected, without using the user dictionary according to the determining result wherein, the user dictionary is able to be used commonly by a plurality of the communication partner selection functions, and wherein, in a case where any one of the plurality of communication partner selection functions is executed and the read-aloud processing corresponding to the name information is performed, whatever communication partner selection function is executed from among the plurality of communication partner selection functions, the read-aloud processing corresponding to the name information is performed by using the user dictionary when the name of the communication partner is read-aloud.

* * * * *